United States Patent [19]

Kawamura et al.

[11] Patent Number: 4,624,906

[45] Date of Patent: Nov. 25, 1986

[54] ELECTROPHOTOGRAPHIC SENSITIVE MEMBER HAVING A FLUORINATED AMORPHOUS SILICON PHOTOCONDUCTIVE LAYER

[75] Inventors: Takao Kawamura, 17-11, Takakura-dai 1-chome, Sakai-shi, Osaka; Yoshikazu Nakayama; Koji Akiyama, both of Osaka, all of Japan

[73] Assignees: Kyocera Corporation; Takao Kawamura, both of Kyoto, Japan

[21] Appl. No.: 654,197

[22] Filed: Sep. 24, 1984

[30] Foreign Application Priority Data

May 18, 1984 [JP] Japan ..... 59-100751

[51] Int. Cl.[4] ..... G03G 5/082

[52] U.S. Cl. ..... 430/84; 430/95; 430/128

[58] Field of Search ..... 430/136, 58, 84, 95, 430/96, 128

[56] References Cited

U.S. PATENT DOCUMENTS

| | | | |
|---|---|---|---|
| 4,356,246 | 10/1982 | Tabei et al. | 430/95 |
| 4,365,013 | 12/1982 | Isnioka et al. | 430/84 |
| 4,468,443 | 8/1984 | Shimizu et al. | 430/60 |

*Primary Examiner*—John L. Goodrow

*Attorney, Agent, or Firm*—Spensley Horn Jubas & Lubitz

[57] ABSTRACT

The present invention relates to an electrophotographic sensitive member comprising an amorphous fluorinated silicon photoconductive layer.

12 Claims, 8 Drawing Figures

Figure 1:
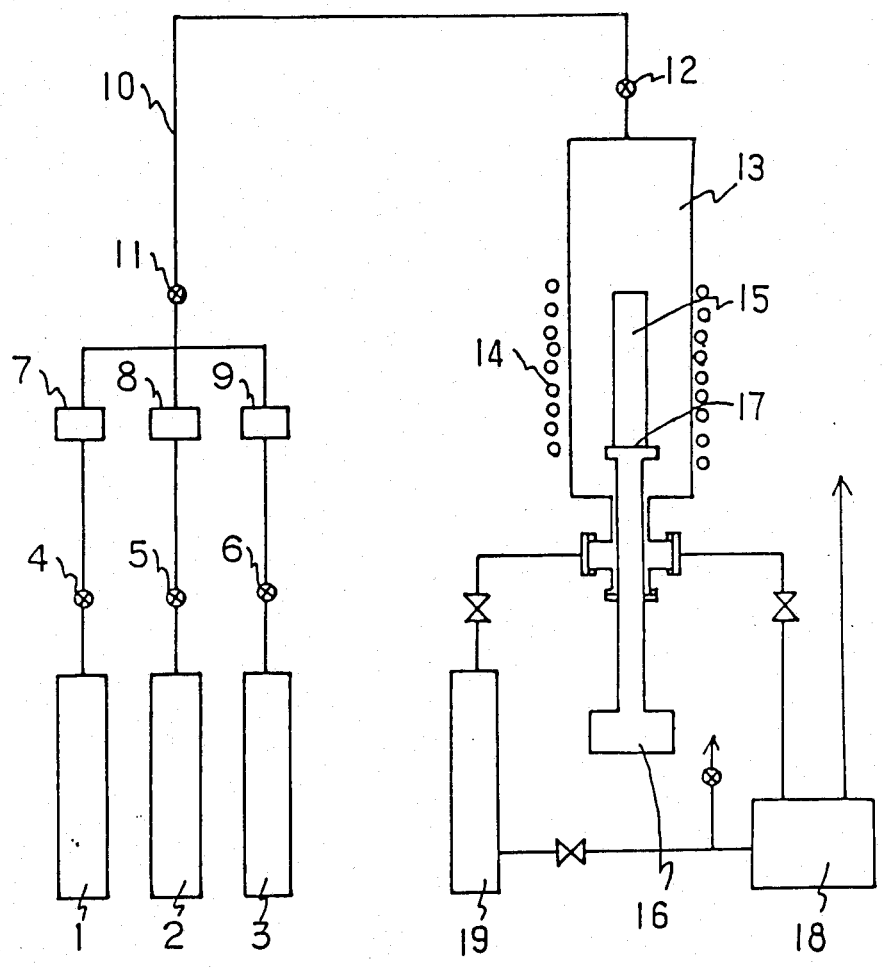

ELECTROPHOTOGRAPHIC SENSITIVE MEMBER HAVING A FLUORINATED AMORPHOUS SILICON PHOTOCONDUCTIVE LAYER

BACKGROUND OF THE INVENTION

The investigations, in which an amorphous hydrogenized silicon film is used in photoelectric conversion devices such as solar cells, optical sensors, electrohotographic sensitive members, imaging elements and thin film transistor arrays, have been carried out. However, although an amorphous hydrogenized silicon film is suitably used for photoelectric conversion devices, it has a problem in durability when it is used in such devices that are used under the severe condition, for example solar cells for electric power and electrophotographic sensitive members for use in ultra-high speed copying since an amorphous hydrogenized silicon film is not in a state of thermal equilibrium and turned into a state stable in structure when it receives an external thermal energy and optical energy.

On the contrary, it has been believed that an amorphous fluorinated silicon film is superior to an amorphous hydrogenized silicon film in stability, whereby capable of being used in photoelectric conversion devices requiring high durability under the severe condition more satisfactorily than an amorphous hydrogenized silicon film since fluorine is a monovalent element and finishes a dangling bond alike to hydrogen, the bond energy between a silicon atom and a fluorine atom being larger than that between a silicon atom and a hydrogen atom.

An electrophotographic sensitive member using an amorphous fluorinated silicon film as a photoconductive layer requires excellent photosensitive characteristics and dark resistance of $10^{13}\Omega$.cm or more. But the photosensitive characteristics and dark resistance of an amorphous fluorinated silicon film formed by a flow discharge decomposition method are dependent upon various kinds of discharge condition such as a reaction pressure and a high-frequency electric power, whereby it has been difficult for said photosensitive member to exhibit an excellent effect all over electrophotographic characteristics.

Furthermore, in order to form an amorphous fluorinated silicon film photoconductive layer having excellent photosensitive characteristics and dark resistance with high reproducibility under the stabilized condition, the present invention provides an electrophotographic sensitive member comprising a hydrogen and fluorine containing amorphous silicon photoconductive layer having an absorption coefficient ratio of the peaks of 827 $cm^{-1}$ 'to 1015 $cm^{-1}$ in an infrared absorption spectrum of 1.3 or more.

SUMMARY OF THE INVENTION

The present invention relates to an electrophotographic sensitive member comprising an amorphous fluorinated silicon photoconductive layer.

Since 1975 when Spear, LeComber and others succeeded first in the valence electron control by using an amorphous hydrogenized silicon (hereinafter referred to as a-Si:H while an amorphous silicon is referred to as a-Si) film obtained from silane gas ($SiH_4$) by a glow discharge decomposition method, the scientific and practical researches and developments of a-Si:H film have been very actively carried out.

Since dangling bonds are finished with hydrogen and the number of dangling bonds can be decreased to an order of $10^{15}$ $cm^{-3}$ in such a-Si:H film, a local level density in an inhibit zone can be remarkably reduced and the addition of phosphor and boron makes the valence electron control possible. In short, such an a-Si:H film has the characteristics incidental to crystalline semiconductors capable of carrying out the valence electron control and has the advantages that it can be easily formed in a thin film, its area being able to be increased, and it being inexpensive. Accordingly, the applied investigations using an a-Si:H film in photoelectric conversion devices such as solar cells, electrophotographic sensitive members, imaging elements and thin film transistor arrays have been rapidly carried out.

Although, as described above, an a-Si:H film is suitably used for photoelectric conversion devices, it has a problem in durability when it is used in such devices that are used under the severe condition, for example solar cells for electric power and electrophotographic sensitive members for use in ultra-high speed copying since in general amorphous materials such as an a-Si:H film are not in a state of thermal equilibrium and turned into a state stable in structure when it receives an external thermal energy and optical energy. In fact, it was reported that when an a-Si:H film is subjected to the strong radiation of light for a long time, its dark resistance is reduced, hydrogen being released from said film, whereby it is deteriorated in electrical characteristics.

In the light of the above described matters, an amorphous fluorinated silicon (hereinafter referred to as a-Si:H:F) film was watched with interest. It is believed that an a-Si:H:F film is superior to an a-Si:H film in stability, whereby capable of being used in photoelectric conversion devices requiring high durability under the severe condition more satisfactorily than an a-Si:H film since fluorine is a monovalent element and finishes a dangling bond alike to hydrogen, the bond energy between a silicon atom and a fluorine atom (5.03 eV) being larger than that between a silicon atom and a hydrogen atom (3.10 eV).

An electrophotographic sensitive member using an a-Si:H:F film as a photoconductive layer requires excellent photosensitive characteristics and dark resistance of $10^{13}\Omega$.cm or more. But the photosensitive characteristics and dark resistance of an a-Si:H:F film formed by a glow discharge decomposition method are dependent upon various kinds of discharge condition such as a reaction pressure and a high-frequency electric power, whereby it has been difficult to obtain an a-Si:H:F film exhibiting an excellent effect all over electrophotographic characteristics.

Furthermore, in order to form an a-Si:H:F photoconductive layer having excellent photosensitive characteristics and dark resistance with high reproducibility under the stabilized condition, a detecting means capable of evaluating both photosensitive characteristics and dark resistance is being desired.

The present invention was achieved in the light of the above described matters. Thus, it is an object of the present invention to provide an electrophotographic sensitive member comprising an a-Si photoconductive layer using an a-Si:H:F film having improved photosensitive characteristics and dark resistance therein.

It is another object of the present invention to provide an electrophotographic sensitive member superior in reproducibility and stability which can be produced under the easily settable conditions in accordance with a glow discharge decomposition method.

According to the present invention, an electrophotographic sensitive member, characterized by comprising a hydrogen and fluorine containing a-Si photoconductive layer having an absorption coefficient ratio of the peaks of 827 $cm^{-1}$ to 1015 $cm^{-1}$ in an infrared absorption spectrum, of 1.3 or more, can be provided.

Figure 3:
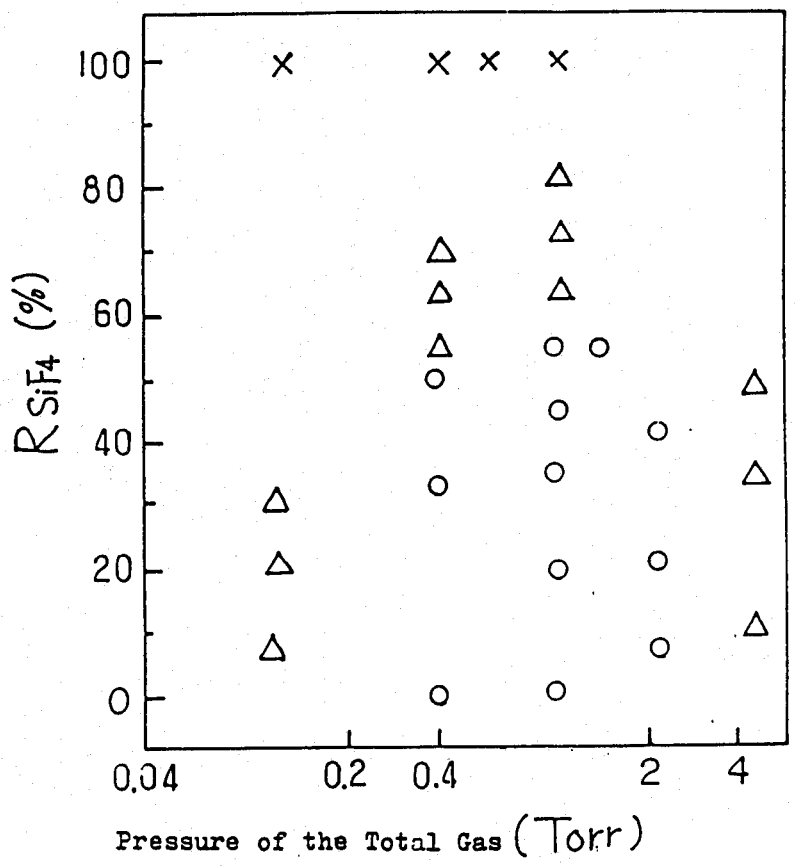
Figure 4:
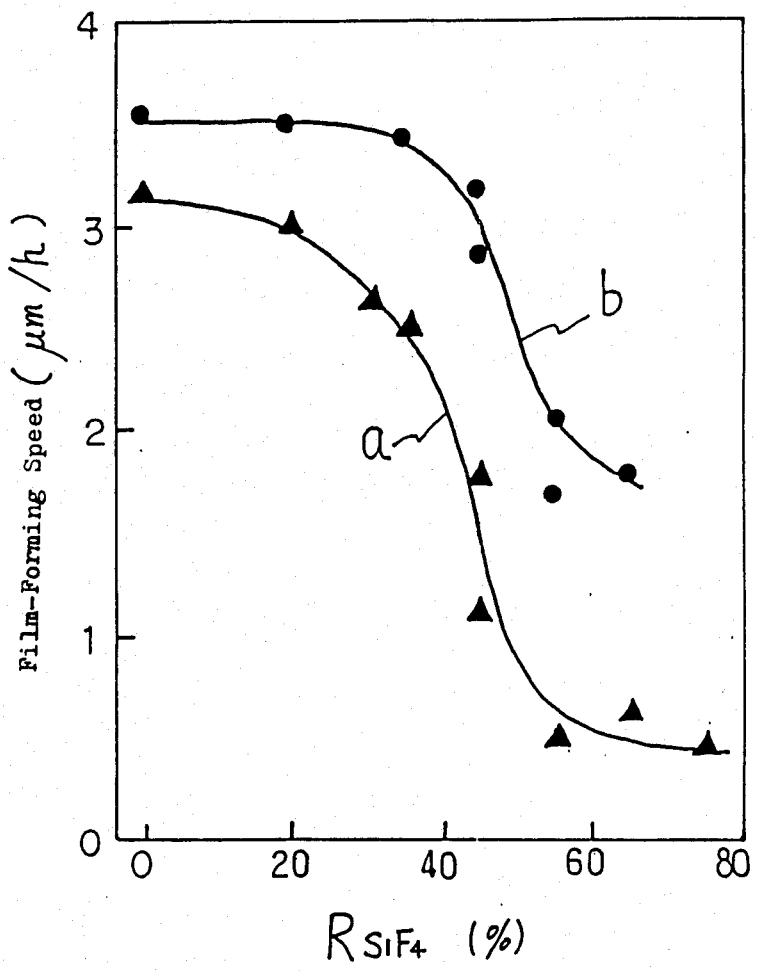
Figure 5:
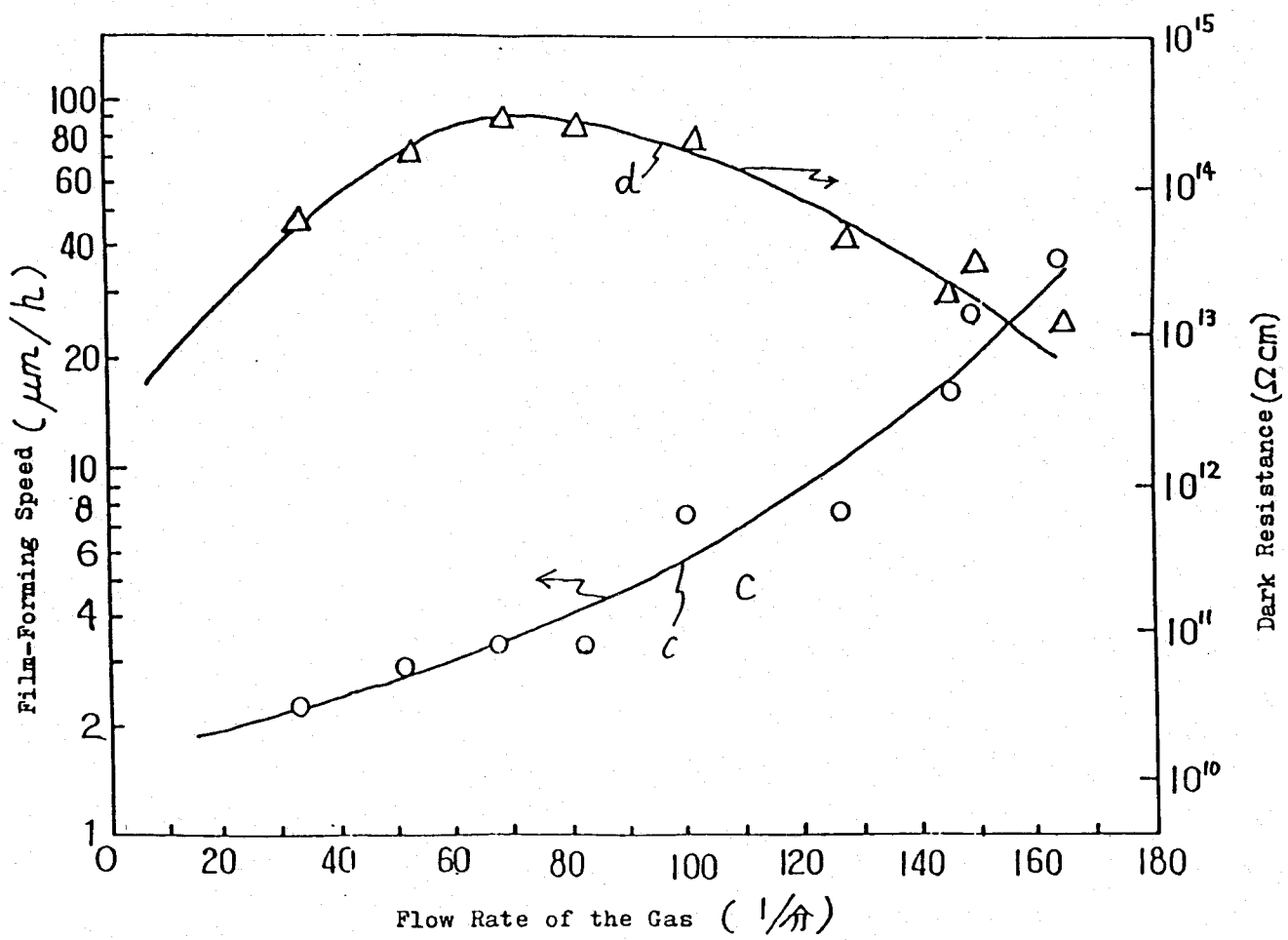
Figure 6:
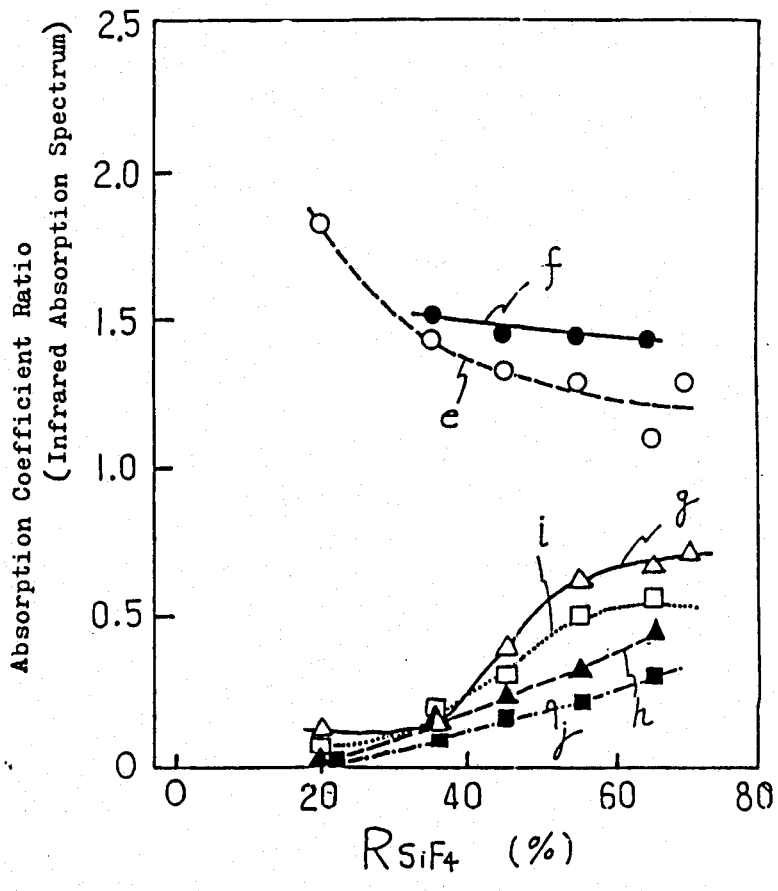
Figure 7:
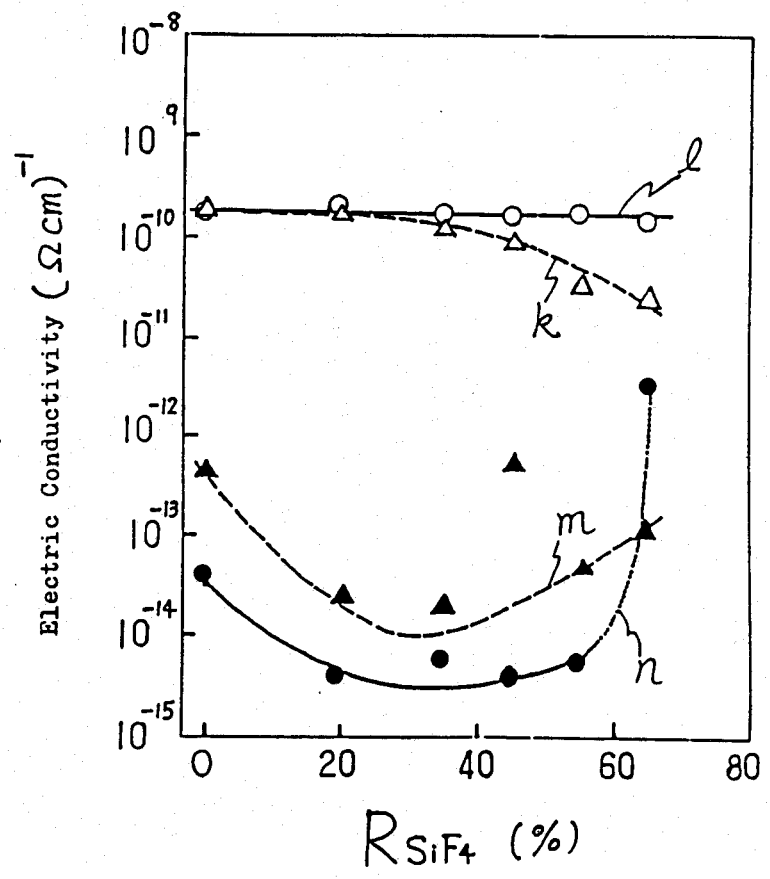
Figure 8:
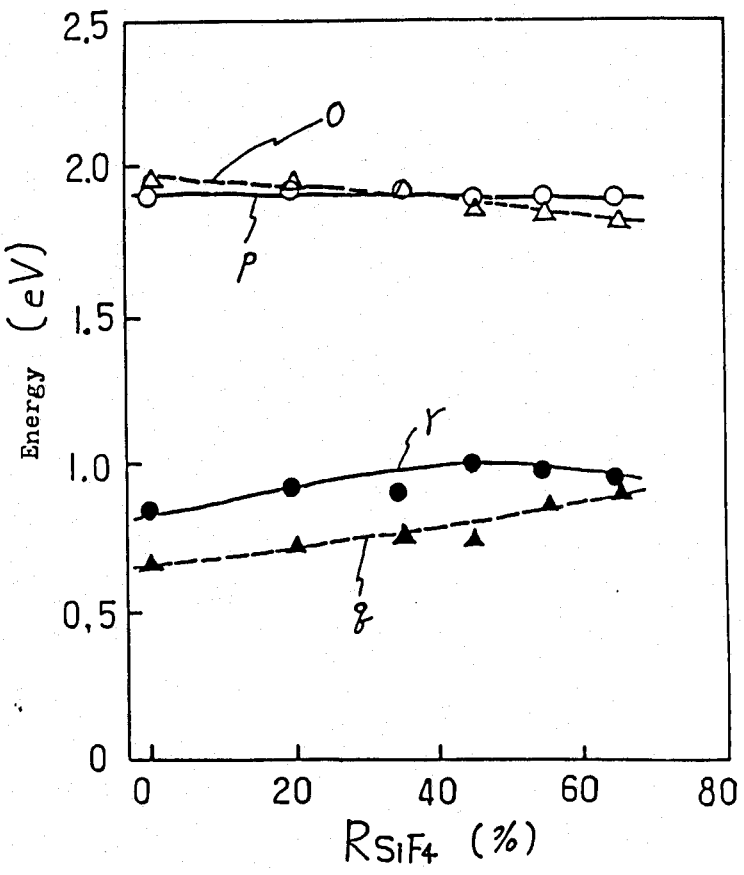

The present invention will be described below in detail with reference to the drawings, in which FIGS, 1, 2 show a glow discharge decomposition apparatus for forming an amorphous fluorinated silicon film, FIG. 3 is a graph showing the relation between the state of the formed film and the pressure of gas as well as the $SiF_4$-content in gas used in a flow discharge decomposition, FIG. 4 is a graph showing the relation between the forming speed of an a-Si:H:F film and the $SiF_4$-content in gas used in a glow discharge decomposition, FIG. 5 is a graph showing the relation between the forming speed as well as dark resistance of an a-SI:H:F film and the velocity of flow of gas used in a glow discharge decomposition, FIG. 6 is graph showing the relation between the absorption coefficient ratio of an a-Si:H:F film in an infrared absorption spectrum and the $SiF_4$-content in gas used in a glow discharge decomposition, FIG. 7 is a graph showing the relation between the dark electric conductivity as well as the photoconductivity of an a-Si:H:F film and the $SiF_4$-content in gas used in a glow discharge decomposition, and FIG. 8 is a graph showing the relation between an optical gap as well as the activation energy of the dark electric conductivity of an a-Si:H:F film and the $SiF_4$-content in gas used in a glow discharge decomposition.

In the drawings, e, f, g, h, i and j show the relation between the absorption coefficient ratio of an a-Si:H:F film in an infrared absorption spectrum and the $SiF_4$-content in gas used in a glow discharge decomposition, k and l show the relation between the photoconductivity of an a-Si:H:F film and the $SiF_4$-content in gas used in a glow discharge decomposition, m and n show the relation between the dark electric conductivity of an a-Si:H:F film and the $siF_4$-content in gas used in a glow discharge decomposition, o and p show the relation between an optical gap of an a-Si:H:F film and the $SiF_4$-content in gas used in a glow discharge decomposition, and q and r show the relation between the activation energy of the dark electric conductivity of an a-Si:H:F film and the $SiF_4$-content in gas used in a glow discharge decomposition.

An a-Si:H:F film is formed by a glow discharge decomposition method which will be described later.

The photosensitive characteristics and dark resistance of the formed film are dependent upon various kinds of discharging condition such as the reaction pressure and high-frequency electric power. So, the present inventors found from the repeated various experiments aiming at the explanation of the cause of the above-mentioned that the bonding state between Si and F in an a-Si:H:F film had a great influence upon the electrohotographic characteristics thereof.

That is to say, it was confirmed by taking an infrared absorption spectrum of an a-Si:H:F film that it exhibited an absorption peak of wavenumber of 827 $cm^{-1}$ showing si—$F_2$ bonds and an absorption peak of wavenumber of 1015 $cm^{-1}$ showing Si—$F_3$ bonds as absorption peaks showing bonds between Si and F in addition to absorption peaks showing bonds between Si and H in the wavenumber region of about 1900 to 2100 $cm^{-1}$. Accordingly, it is found that $\alpha(827)/\alpha(1015)$, which is a ratio of an absorption coefficient $\alpha(827)$ to an absorption coefficient $\alpha(1015)$, is used as a criterion for showing the bonding state of fluorine.

The present inventors found that mainly $\alpha(827)/\alpha(1015)$ had an influence upon electrophotographic characteristics and an a-Si:H:F film containing a less amount of Si—$F_3$ bond was more superior in the photosensitive characteristics and the dark resistance.

Accordingly, it is necessary for $\alpha(827)/\alpha(1015)$ only to be 1.3 or more in order to increase photosensitive characteristics to a practically usable extent and obtain the dark resistance of $10^{13}\Omega$.cm or more. As a result, the producing conditions can be set up with a numerical value of $\alpha(827/\alpha(1015)$ as a criterion, whereby an electrophotographic sensitive member superior in reproducibility and stability can be provided.

Next, methods of forming an a-Si:H:F film are concretely described in detail.

Differently from an a-Si:H film, an a-Si:H:F film is formed from fluorine containing silicon compounds such as $SiF_4$. Since this gas exhibits a strong etching action in a plasma, it is possible to form an a-Si:H:F film from only fluorine containing silicon compounds by a glow discharge decomposition method. So, the present inventors carried out the experiments in which (i) $SiF_4+H_2$ gaseous mixture, (ii) $SiF_4+SiH_4$ gaseous mixture and (iii) $SiF_4+SiH_4+H_2$ gaseous mixture is used as the gas for forming an a-Si layer, respectively. It was found from the above described experiments that according to a method of (i), the conditions, under which an a-Si layer can be formed, are restricted within a remarkably narrow region and the film-forming speed is very small to such an extent of about 0.46 μm/hour; according to a method of (ii), the film-forming speed being at most about 2 μm/hour; and according to a method of (iii), the film-forming speed of ten and several μm/hour to several tens μm/hour being reached and in this time it being important to set up the pressure and composition of a gas used in a glow discharge decomposition.

That is to say, preferably the pressure of a gas for forming an a-Si layer, which is a gaseous mixture consisting of fluorine containing silicon compounds, hydrogen containing silicon compounds and a carrier gas consisting of hydrogen and rare gases, is set up to 0.2 to 3 Torr during a glow discharge decomposition.

If the pressure of a gas for forming an a-Si layer is outside of the region according to the present invention, it is difficult to form an a-Si film in dependence upon the content of said fluorine containing silicon compounds in the total gas and the film-forming speed is small and the resulting film is remarkably inferior in photosensitive characteristics and dark resistance even though it can be formed.

In addition, it is important to specify the composition of a gas for forming an a-Si layer in dependence upon the pressure thereof. Preferably, the content of fluorine containing silicon compounds is set up to 20 to 50% by volume based on the total amount of said fluorine containing silicon compounds and hydrogen containing silicon compounds.

If this content of said fluorine containing silicon compounds exceeds 50% by volume, the film is separated or the film can not be formed. On the contrary, if said content of said fluorine containing silicon compounds is less than 20% by volume, a film containing fluorine at a remarkably little ratio is formed, whereby an a-Si film superior in durability can not be formed.

Further, the present inventors found from the repeated various kinds of experiment that it was important to set up the flow rate of said gas for forming an a-Si layer within 20 to 150/min based on the volume of a glow discharge decomposition zone in dependence upon said pressure and composition of said gas.

It is a reason of the above described specification of the flow rate of said gas for forming an a-Si layer that although the film-forming speed is increased with an increase of the flow rate of the gas, the resulting a-Si layer is remarkably deteriorated in photosensitive characteristics and dark resistance, whereby it can not be satisfactorily used in practice as an electrophotographic sensitive member. The special relation has not been found between the flow rate of a gas and the shape as well as the size of a substrate on which an a-Si:H:F film is to be formed. It can be said that said flow rate of 20 to 150/min can be applied to almost all kinds of substrate of an electrophotographic sensitive member.

Fluorine containing silicon compounds according to the present invention include various compounds such as $SiF_4$, $Si_2F_6$ and $Si_3F_8$. Hydrogen containing silicon compounds according to the present invention include various compounds such as $SiH_4$, $Si_2H_6$ and $Si_3H_8$.

Furthermore, the present invention is characterized by that said gas for forming an a-Si layer is a gaseous mixture consisting of said silicon compounds and a carrier gas consisting of $H_2$ gas or rare gases such as Ar and He. It is desired that the content of said carrier gas is set up within a range of 50 to 90% by volume based on the total gas since said carrier gas can improve photosensitive characteristics and the dark resistance of the resulting a-Si layer. In addition, the present inventors confirmed by various kinds of experiment that in particular $H_2$ gas and He gas were effective for the improvement of an a-Si layer in photosensitive characteristics and dark resistance.

Next, an induction-bonded type glow discharge decomposition apparatus for forming an a-Si:H:F film will be described with reference to FIG. 1.

$H_2$, $SiF_4$ and $SiH_4$ is enclosed in the first tank 1, the second tank 2 and the third tank 3, respectively. Hydrogen is used as said carrier gas. Said gases are released by opening the corresponding first adjusting valve 4, second adjusting valve 5 and third adjusting valve 6 and transferred from said first tank 1, second tank 2 and third tank 3 to a gas pipe 10 with controlling the flow rate thereof by means of mass-flow controllers 7, 8, 9. 11, 12 designate stop valves. Said gases are transferred to a reaction chamber 13 through said gas pipe 10, said reaction chamber 13 being provided with a resonance coil 14 wound around the circumference thereof. The high-frequency electric power of said resonance coil 14 is preferably 50 watts to 3 kilowatts. In addition, the frequency thereof is preferably 1 to several tens MHz. A cylindrical substrate 15, on which an a-Si:H:F film is to be formed, such as an aluminum plate and a NESA glass plate is placed on a turntable 17, which is in turn rotatable by means of a motor 16, in said reaction chamber 13, said substrate 15 being uniformly heated to temperatures of about 100° to 400° C., preferably about 150° to 250° C., by suitable heating means per se. In addition, since the high vacuum state (discharging pressure of 0.2 to 3 Torr) is required to be held inside said reaction chamber 13 in the formation of an a-Si:H:F film, said reaction chamber 13 is connected with a rotary pump 18 and a diffusion pump 19.

In a glow discharge decomposition apparatus having the above described construction, $H_2$ gas, $SiF_4$ gas and $SiH_4$ gas is discharged from said first tank 1, second tank 2 and third tank 3, respectively by opening said first adjusting valve 4, second adjusting valve 5 and third adjusting valve 6, respectively and the flow rate of said gases discharged is controlled by said mass-flow controller 7, 8, 9, respectively. Thus a gaseous mixture, of which composition was set up within the appointed range and of which flow rate was specified, is transferred into said reaction chamber 13. As a result, the degree of vacuum inside said reaction chamber 13 is set up to 0.2 to 3 Torr, the temperature of a substrate being set up to 100° to 400° C., the high-frequency electric power of said resonance coil 14 being set up to 50 watts to 3 kilowatts, the frequency of said high-frequency waves being set up to 1 to several tens MHz, and further desirably the flow rate of the gas inside said rection chamber 13 being set up within the appointed range. If a glow discharge is produced under these conditions, an a-Si:H:F film is formed at the film-forming speed of 10 and several μm to several tens μm/hour.

A capacitance bonded type glow discharge decomposition apparatus may be used in order to form an a-Si:H:F film in the present invention. This apparatus is shown in FIG. 2. In FIG. 2, the same places as in FIG. 1 are indicated by the same marks as in FIG. 1.

Referring to FIG. 2, the gases are transferred into a reaction chamber 13A through a gas pipe 10, said reaction chamber 13A being provided with a capacitance bonded type discharging electrode 20 arranged around the base plate inside thereof, and a plasma being produced by giving a high-frequency electric power to said capacitance bonded type discharging electrode 20 itself. In a glow discharge decomposition apparatus of this construction, a high-frequency electric power of 50 watts to 3 kilowatts is given to said capacitance bonded type discharging electrode 20 to produce glow discharge between said substrate 15 and said capacitance bonded type discharging electrode 20 in said reaction chamber 13A to decompose the gas, whereby an a-Si:H:F film is formed on said substrate 15 at the constant speed.

The Examples of the present invention will be described below.

EXAMPLE 1

Figure 2:
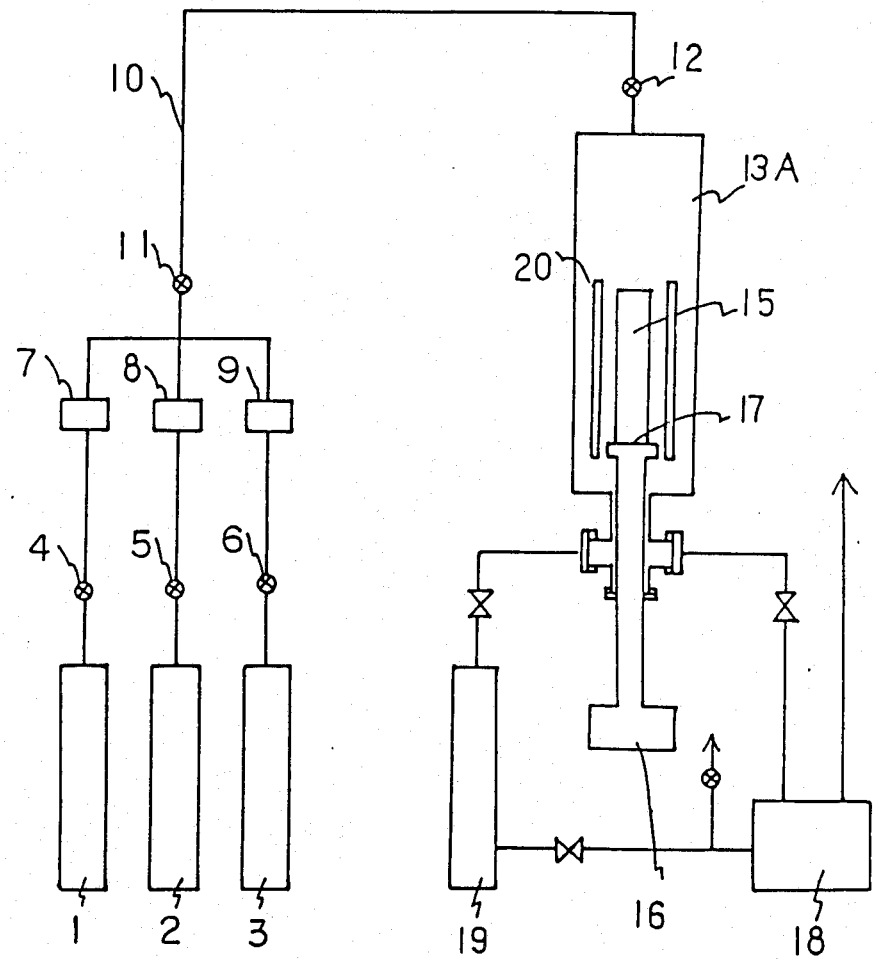

An a-Si:H:F film was formed on a drum-like aluminium substrate in an induction bonded type glow discharge decomposition apparatus as shown in FIG. 1 and the resulting film was tested on the state.

In this Example, a pyrex pipe having an inside diameter of 100 mm and a height of 600 mm is used as said reaction chamber 13, said drum-like aluminium substrate 15 being placed on a turntable 17 in said reaction chamber 13, $H_2$ gas, $SiF_4$ gas and $SiH_4$ gas being discharged from the first tank 1, the second tank 2 and the third tank 3, respectively, and the gas composition in a glow discharge atmosphere being determined in dependence upon the ratio among flow rates of $H_2$ gas, $SiF_4$ gas and $SiH_4$ gas.

The glow discharge decomposition zone in said pyrex pipe is determined by the zone in which said resonance coil 14 is arranged. In this Example, if the height of said glow discharge decomposition zone is set up to 100 mm, the volume of said glow discharge decomposition zone is 785 $cm^3$. Accordingly, if the flow rate of a gaseous mixture comprising $SiF_4$, $SiH_4$ and $H_2$ used for forming an a-Si layer is set up to 88 sccm, the volume of the gas for forming an a-Si layer introduced into said glow discharge decomposition zone is 34/min based on the volume of said glow discharge decomposition zone.

The experiments were carried out under the conditions that a high-frequency electric power is 200 W, the temperature of a substrate being 200° C., the total flow rate of $SiF_4$ gas and $SiH_4$gas being 11 sccm, and the content of $SiF_4$ gas in the total gas [$R_{SiF4}=SiF_4/(SiF_4+SiH_4)$] being variable. The results are shown in FIG. 3.

○ marks show that a uniform film of good quality if formed, Δ marks showing that a film is separated, and X marks showing that a film can not be formed.

It is found from FIG. 3 that if the pressure of the gas inside said reaction chamber 13 and the $SiF_4$-content of said gas are within the range according to the present invention, a uniform film of good quality can be formed.

EXAMPLE 2

The experiments were carried out in the same manner as in Example 1 under the conditions that a high-frequency electric power is 200 W, the pressure of the gas inside the reaction chamber being set up to 2.5 Torr, the flow rate of the gas being set up to 34/min and 68/min, and the content of $SiF_4$ in the total gas ($R_{SiF4}$) being variable. The film-forming speed was investigated. The results are shown in FIG. 4. ▲ marks and ● marks show the results in cases where the flow rate of the gas is set up to 34/min and 68/min, respectively, the curve a, b showing the relation between the forming speed of an a-Si:H:F film and the $SiF_4$-content in the gas used in a glow discharge decomposition in cases where the flow rate of the gas is set up to 34/min and 68/min, respectively.

It is found from FIG. 4 that the film-forming speed in cases where the flow rate of the gas is set up to 68/min is larger than that in cases where the flow rate of the gas is set up to 34/min at the same $R_{SiF4}$. Also it is found that the reduction of the film-forming speed with an increase of $R_{SiF4}$ is resulted from an increase of the flow rate of $SiF_4$ gas in addition to a decrease of the flow rate of $SiH_4$ gas in both cases where the flow rate of the total gas is set up to 34/min and cases where it is set up to 68/min and an increase of the flow rate of $SiF_4$ gas leads to a reduction of the film-forming speed since $SiF_4$ exhibits an etching action in a plasma.

EXAMPLE 3

In this Example, the experiments were carried out on an influence of the flow rate of the gas upon the dark resistance of an a-Si:H:F film.

An a-Si:H:F film was formed in the same manner as in Example 1 under the conditions that a high-frequency electric power is set up to 200 W, the pressure of the gas inside a reaction chamber being set up to 2.5 Torr, $R_{SiF4}$ being set up to 40%, and the flow rate of the gas being variable. The film-forming speed and the dark resistance of the resulting film were measured. The results are shown in FIG. 5.

In FIG. 5, the curve c shows the relation between the film-forming speed and the flow rate of the gas and the curve d shows the relation between the dark resistance and the flow rate of the gas.

It is found from FIG. 5 that although the film-forming speed is increased with an increase of the flow rate of the gas, it is desired that the flow rate of the gas is set up within a range of 20 to 150/min in order to obtain the dark resistance of $10^{13}\Omega$.cm or more.

EXAMPLE 4

An a-Si:H:F film was formed in the same manner as in Example 1 under the conditions that a high-frequency electric power is set up to 200 W, the pressure of the gas inside a reaction chamber being set up to 2.5 Torr, the flow rate of the gas being set up to 34/min and 68/min, and the $SiF_4$-content of the gas ($R_{SiF4}$) being variable. The relation between an absorption coefficient ratio in an infrared absorption spectrum and $R_{SiF4}$, the relation between the dark conductivity and $R_{SiF4}$, the relation between the photoconductivity and $R_{SiF4}$ and the relation between the photosensitive characteristics and $R_{SiF4}$ were investigated.

FIG. 6 shows the relation between the absorption coefficient ratio in an infrared absorption spectrum and $R_{SiF4}$. In FIG. 6, ○ marks and ● marks show $\alpha(827)/\alpha(1015)$ in cases where the flow rate of the gas is set up to 34/min and cases where the flow rate of the gas is set up to 68/min, respectively and the curve e and the curve f shows the relation between the absorption coefficient ratio in an infrared absorption spectrum and $R_{SiF4}$ in cases where the flow rate of the gas is set up to 34/min and cases where the flow rate of the gas is set up to 68/min, respectively.

In addition, $\alpha(827)/\alpha(640)$ and $\alpha(1015)/\alpha(640)$ was shown as a parameter indicating the relative change of the concentration of $SiF_2$-bonds and $SiF_3$-bonds, respectively. These two absorption coefficient ratios express a rate of the quantity of F bonded to the total quantity of Si and H bonded since $\alpha(640)$ is resulted from the total bonds of Si and H. In FIG. 6, Δ marks and ▲marks show $\Delta(827)/\alpha(640)$ in cases where the flow rate of the gas is set up to 34/min and 68/min, respectively and the curve g and the curve h shows the relation between the absorption coefficient ratio in an infrared absorption spectrum and $R_{SiF4}$ in cases where the flow rate of the gas is set up to 34/min and 68/min, respectively. □ marks and ■ marks show $\alpha(1015)/\alpha(640)$ in cases where the flow rate of the gas is set up to 34/min and 68/min, respectively and the curve i and the curve j shows the relation between $\alpha(1015)/\alpha(640)$ and $R_{SiF4}$ in cases where the flow rate of the gas is set up to 34/min and 68/min, respectively.

According to FIG. 6, both $\alpha(827)/\alpha(640)$ and $\alpha(1015)/\alpha(640)$ are increased with an increase of $R_{SiF4}$ when the flow rate of the gas is small while $\alpha(827)/\alpha(1015)$ is reduced with an increase of $R_{SiF4}$. Also when the flow rate of the gas is large, $\alpha(827)/\alpha(640)$ $\alpha(640)$ and $\alpha(1015)/\alpha(640)$ are increased with an increase of $R_{SiF4}$ but its rate is little. $\alpha(827)/\alpha(1015)$ shows the almost constant value of 1.5 regardless of $R_{SiF4}$.

It was found from the above described that although the quantity of F bonded in a film was increased with an increase of the flow rate of $SiF_4$ gas, this increase, in particular an increase of a higher F-bond ($SiF_3$bond) was remarkable.

In addition, it was confirmed from the quantitative determination of hydrogen on the basis of an absorption peak of 640 $cm^{-1}$ that there was no remarkable relation between the hydrogen-content and the flow rate of the gas as well as $R_{SiF4}$ and the hydrogen-content was within a range of 15 to 20 atomic % which was near the hydrogen-content of general a-Si:H films (18 atomic %).

Next, FIG. 7 shows the relation between the dark conductivity as well as the photoconductivity and $R_{SiF4}$ at room temperature. The mesurements of the dark conductivity and the photoconductivity were carried out for a monochromatic light having a wave length of 650 nm and the strength of 50 $\mu W/cm^2$.

In FIG. 7, Δmarks and ○ marks show the photoconductivity in cases where the flow rate of the gas is set up to 34/min and 68/min. respectively and the curve k and the curve 1 shows the relation between the photoconductivity and $R_{SiF4}$ in cases where the flow rate of the gas is set up to 34/min and 68/min, respectively. In addition,▲marks and ● marks show the dark conductivity in cases where the flow rate of the gas is set up to 34/min and 68/min, respectively and the curve m and the curve n shows the relation between the dark conductivity and $R_{SiF4}$ in cases where the flow rate of the gas is set up to 34/min and 68/min, respectively.

As obvious from FIG. 7, the dark conductivity shows the minimum value at $R_{SiF4}$ of 35% and the photoconductivity shows a value of $22\times10^{-10}$ /cm at $R_{SiF4}$ of 0 %, showing a tendency to reduce when $R_{SiF4}$ exceeds 35% in cases where the flow rate of the gas is set up to 34/min. On the other hand, in cases where the flow rate of the gas is set up to 68/min, the dark conductivity is almost constant (up to $5\times10^{-15}$ /cm) in a wide range of $R_{SiF4}$of 20 to 55% substantially regardless of $R_{SiF4}$. This value is good for electrophotographic characteristics.

FIG. 8 shows the relation between an optical gap $E_{gopt}$ as well as the activation energy $E_a$ of the dark conductivity and $R_{SiF4}$. $E_{gopt}$ was determined by extrapolating the relation between $\sqrt{\alpha h\gamma}$ and $h\gamma$, wherein $\alpha$ is an absorption coefficient of visible rays and $\gamma$ is a wavenumber.

In FIG. 8 Δmarks and ○ marks show an optical gap $E_{gopt}$ in cases where the flow rate of the gas is set up to 34/min and 68/min, respectively and the curve o and the curve p shows the relation between an optical gap and $R_{SiF4}$ in cases where the flow rate of the gas is set up to 34/min and 68/min, respectively. ▲marks and ● marks show the activation energy of dark conductivity in cases where the flow rate of the gas is set up to 34/min and 68/min, respectively and the curve q and the curve r shows the relation between the activation energy of dark conductivity and $R_{SiF4}$ in cases where the flow rate of the gas is set up to 34/min and 68/min, respectively.

As obvious from FIG. 8, $E_{gopt}$ is almost constant regardless of $R_{SiF4}$ in cases where the flow rate of the gas is set up to 68/min and shows a slightest reduction with an increase of $R_{SiF4}$ in a range of 1.8 to 1.9 eV also in cases where the flow rate of the gas is set up to 34/min. Accordingly, it can be thought that $E_{gopt}$ is substantially not dependent upon $R_{SiF4}$.

In addition, it is found from an increase of the activation energy $E_a$ up to the degree of $E_{gopt}/2$ with an increase of $R_{SiF4}$ that Fermi level is shifted from the conductive zone side to the center of the inhibit zone. It can be guessed from the above-mentioned that the reduction of dark conductivity found in FIG. 7 is due to an increase of activation energy $E_a$ and fluorine in a film functions alike to an acceptor. However, the relation between the activation energy of dark conductivity nd $R_{SiF4}$ is inconsistent with the above-mentioned in cases where the flow rate of the gas is set up to 34/min and $R_{SiF4}$ is larger than 35%. Taking the simultaneous reduction of photoconductivity into consideration, perhaps an increase of local level in the inhibit zone is the reason of the above described inconsistency. Taking the change of the bonding state of atoms as shown in FIG. 6 into consideration, this local level is due to $SiF_3$-bonds.

Accordingly, since an a-Si:H:F film containing a small amount of $SiF_3$-bond therein has dark resistance of $10^{14}\Omega$.cm or more and high photogain to such an extent that (photoconductivity/dark conductivity) measured for the light of 650 nm at the strength of 50 $\mu W/cm^2$ is $5\times10^4$, it is an excellent material for an electrophotographic photosensitve member. The present inventors confirmed from the repeated various experiments that the practically satisfactory electrophotographic characteristics could be resulted when $\alpha(827)/\alpha(1015)$ was 1.3 or more.

The above described Examples show that according to the present invention, an a-Si:H:F film, which has an absorption coefficient ratio $\alpha(827)/\alpha(1015)$ of 1.3 or more and can be used as an a-Si photoconductive layer having superior photosensitive characteristics and dark resistance in addition to remarkably superior durability, can be provided and further an electrophotographic photosensitive member, of which producing conditions can be easily set up and which is superior in reproducibility and stability, can be provided by setting up the absorption coefficient ratio within the appointed range.

Also it was found that the film-forming speed of an a-Si photoconductive layer could be increased with holding excellent electrophotographic characteristics by setting up the pressure and the composition of a glow discharge atmosphere within the appointed range and it was necessary to set up the flow rate of gas within the appointed range in order to achieve excellent electrophotographic characteristics.

What is claimed is:

1. An electrophotographic sensitive member, characterized by comprising a hydrogen and fluorine containing amorphous silicon photoconductive layer having an absorption coefficient ratio of the peaks of 827 $cm^{-1}$ to 1015 $cm^{-1}$ in an infrared absorption spectrum of 1.3 or more.

2. A process for producing an electrophotographic sensitive member comprising the steps of introducing a substrate into a reaction chamber of a glow discharge apparatus, introducing gases for forming an amorphous silicon layer into the reaction chamber and generating a glow discharge inside the reaction chamber to thereby form a hydrogen and fluorine containing amorphous silicon photoconductive layer on the substrate, wherein the pressure of the gases for forming the amorphous silicon layer ranges from 0.2 to 3 Torr during the glow discharge, and wherein the gases for forming the amorphous silicon layer comprise a fluorine containing silicon compound, a hydrogen containing silicon compound and a carrier gas, the ratio of the volume of the fluorine containing silicon compound to the total volume of the fluorine containing silicon compound and the hydrogen containing silicon compound ranging from 0.20:1 to 0.50:1.

3. A process for producing an electrophotographic sensitive member as set forth in claim 2, characterized by that the flow rate of the gaseous mixture introduced into a glow discharge decomposition zone inside said reaction chamber for forming the amorphous silicon layer ranges from 20 to 150/min based on the volume of said glow discharge decomposition zone.

4. A process for producing an electrophotographic sensitive member as set forth in claim 2, characterized by that said carrier gas is hydrogen gas.

5. A process for producing an electrophotographic sensitive member as set forth in claim 2, characterized by that said carrier gas is a rare gas.

6. A process for producing an electrophotographic sensitive member as set forth in claim 5, characterized by that said rare gas is helium gas.

7. A process for producing an electrophotographic sensitive member as set forth in claim 2, characterized by that the ratio of the volume of said carrier gas to the total volume of the gas used for forming the amorphous silicon layer ranges from 0.50:1 to 0.90:1.

8. A process for producing an electrophotographic sensitive member as set forth in claim 2, characterized by that said fluorine containing silicon compound is $SiF_4$.

9. A process for producing an electrophotographic sensitive member as set forth in claim 2, characterized by that said hydrogen containing silicon compound is $SiH_4$.

10. An electrohotographic sensitive member comprising a substrate and a fluorinated amorphous silicon photoconductive layer in intimate contact with the substrate, the photoconductive layer containing $Si—F_2$ bonds having an absorption peak of wavenumber 827 $cm^{-1}$ and $Si—F_3$ bonds having an absorption peak of wavenumber 1015 $cm^{-1}$ wherein the ratio of the absorption coefficient of the 827 $cm^{-1}$ peak to the absorption coefficient of the 1015 $cm^{-1}$ peak is at least 1.3.

11. A glow discharge process for producing an electrophotographic sensitive member of the type having a substrate and an amorphous fluorinated silicon photoconductive layer in intimate contact therewith, the process comprising the following steps:

providing a glow discharge reaction chamber in which a glow discharge is generated;

forming a gaseous mixture comprising a silicon compound containing fluorine, a silicon compound containing hydrogen and a carrier gas wherein the ratio of the volume of the silicon compound containing fluorine to the combined volume of the silicon compound containing fluorine and silicon compound containing hydrogen ranges from 0.20:1 to 0.50:1;

pressurizing the gaseous mixture to a pressure ranging from 0.2 to 3 Torr; and introducing the pressurized gaseous mixture into the reaction chamber.

12. The electrophotographic sensitive member produced according to the process of claim 11.

* * * * *